US006919784B2

(12) United States Patent
Feng et al.

(10) Patent No.: US 6,919,784 B2
(45) Date of Patent: Jul. 19, 2005

(54) HIGH CYCLE MEMS DEVICE

(75) Inventors: Milton Feng, Champaign, IL (US); Nick Holonyak, Jr., Urbana, IL (US); David Becher, Urbana, IL (US); Shyh-Chiang Shen, Champaign, IL (US); Richard Chan, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 157 days.

(21) Appl. No.: 10/191,812

(22) Filed: Jul. 9, 2002

(65) Prior Publication Data

US 2004/0008099 A1 Jan. 15, 2004

Related U.S. Application Data

(60) Provisional application No. 60/330,405, filed on Oct. 18, 2001.

(51) Int. Cl.[7] ..... H01H 51/22

(52) U.S. Cl. ..... 335/78; 200/181; 361/233

(58) Field of Search ..... 335/78–86; 200/181–182; 361/232–233; 257/414–427

(56) References Cited

U.S. PATENT DOCUMENTS

| | | | | | |
|---|---|---|---|---|---|
| 4,959,515 | A | | 9/1990 | Zavracky et al. | |
| 5,168,249 | A | | 12/1992 | Larson | |
| 5,258,591 | A | | 11/1993 | Buck | |
| 5,677,823 | A | | 10/1997 | Smith | |
| 5,929,497 | A | | 7/1999 | Chavan et al. | |
| 6,046,659 | A | | 4/2000 | Loo et al. | |
| 6,091,050 | A | * | 7/2000 | Carr | 219/201 |
| 6,100,477 | A | | 8/2000 | Randall et al. | |
| 6,124,650 | A | | 9/2000 | Bishop et al. | |
| 6,143,997 | A | * | 11/2000 | Feng et al. | 200/181 |
| 6,307,452 | B1 | | 10/2001 | Sun | |
| 6,437,965 | B1 | * | 8/2002 | Adkins et al. | 361/303 |
| 6,535,091 | B2 | * | 3/2003 | Bechtle et al. | 333/262 |
| 6,700,172 | B2 | | 3/2004 | Ehmke et al. | |
| 6,713,695 | B2 | | 3/2004 | Kawai et al. | |
| 2002/0171517 | A1 | | 11/2002 | Guo et al. | |
| 2004/0050675 | A1 | * | 3/2004 | Feng et al. | 335/18 |

OTHER PUBLICATIONS

J.L. Ebel, A.P. Walker, R.E. Strawser, R. Cortez, K.D. Leedy, G.C. DeSalvo, "Investigation of MEMS RF switches for low loss phase shifters", GOMAC 2001 Digest of Papers, pp. 87–89, Mar. 2001.

C. Goldsmith, J. Ehmke, A. Malczewski, B. Pillans, S. Eshelman, Z. Yao, J. Brank, and M. Eberly, "Lifetime Characterization of Capacitive RF Mems Switches", IEEE MTT–S 2001 International Microwave Symposium Digest, pp. 227–230, May 2001.

C.L. Goldsmith, Zhimin Yao, Susan Eshelman, and David Denniston, "Performance of Low–Loss RF MEMS Capacitive Switches" *IEEE Microwave and Guides Wave Letters*, vol. 8, No. 8, Aug. 1988, pp. 269–271.

N. Scott Barker, Gabriel M. Rebeiz, "Distributed MEMS True–Time Delay Phase Shifters and Wide–Bank Switches", *IEEE Transactions on Microwave Theory and Techniques*, vol. 46, No. 11, Nov. 1988, pp. 1881–1890.

(Continued)

*Primary Examiner*—Lincoln Donovan
(74) *Attorney, Agent, or Firm*—Greer, Burns & Crain, Ltd.

(57) ABSTRACT

A high life cycle and low voltage MEMS device. In an aspect of the invention, separate support posts are disposed to prevent a suspended switch pad from touching the actuation pad while permitting the switch pad to ground a signal line. In another aspect of the invention, cantilevered support beams are made from a thicker material than the switching pad. Increased thickness material in the cantilever tends to keep the switch flat in its resting position. Features of preferred embodiments include dimples in the switch pad to facilitate contact with a signal line and serpentine cantilevers arranged symmetrically to support the switch pad.

19 Claims, 6 Drawing Sheets

Elliot R. Brown, "RF–MEMS Switches for Reconfigurable Integrated Circuits", *IEEE Transactions on Microwave Theory and Techniques*, vol. 46, No. 11, Nov. 1998, pp. 1868–1880.

J. Jason Yao, M. Frank Chang, "A Surface Micromachined Miniature Switch for Telecommunications Applications with Signal Frequencies from DC up to 4 GHZ", IEEE conference paper, 1995, no month.

Chuck Goldsmith, Tsen–Hwang Lin, Bill Powers, Wen–Rong Wu, Bill Norvell, "Micromechanical Membrane Switches for Microwave Applications", *IEEE MTT–S Digest*, 1995, pp. 91–94, no month.

C. Goldsmith Z. Yao, S. Eshelman, D. Denniston, S. Chen, J. Ehmke, A. Malczewski, R. Richards, "Micromachining of RF Devices for Microwave Applications", Raytheon Tl Systems Materials, no date.

J. Jason Yao, Sang Tae Park, and Jeffrey DeNatale, "High Tuning–Ratio MEMS–Based Tunable Capacitors for RF Communications Applications", Solid State Sensor and Actuator Workshop, Hilton Head Island, South Carolina, Jun. 8, 1998.

* cited by examiner

FIG. 5A
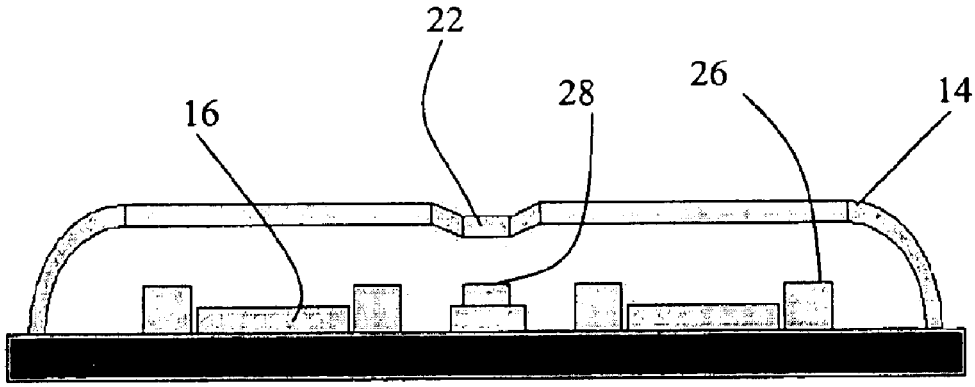
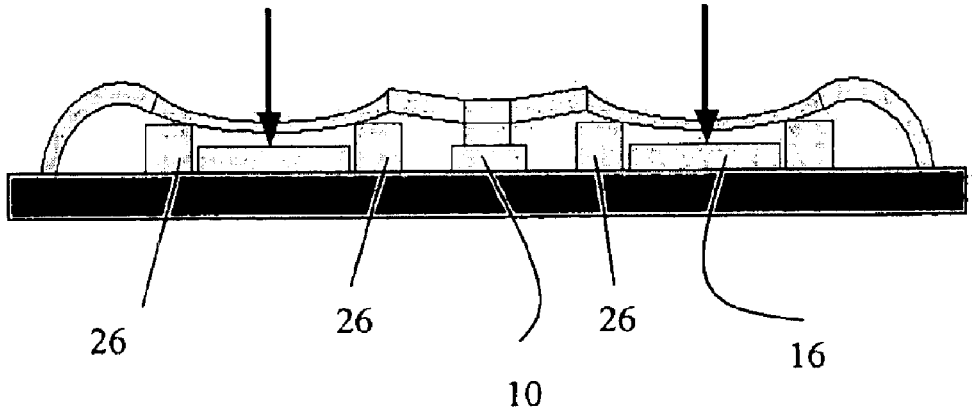
FIG. 5B

HIGH CYCLE MEMS DEVICE

REFERENCE TO RELATED APPLICATION

This application claims priority under 35 U.S.C. §119(e) from provisional application Ser. No. 60/330,405, filed on Oct. 18, 2001.

STATEMENT OF GOVERNMENT INTEREST

This invention was made with Government assistance under DARPA F33615-99-C-1519. The Government has certain rights in this invention.

FIELD OF THE INVENTION

The field of the invention is micro-electromechanical systems (MEMS).

BACKGROUND OF THE INVENTION

MEMS devices are macroscale devices including a pad that is movable in response to electrical signaling. The movable pad, such as a membrane or cantilevered metal arm, moves in response to an electrical signal to cause an electrical effect. One example is a membrane variable capacitor. The membrane deforms in response to an electrical signal. The membrane itself is part of a capacitor, and the distance between the membrane and another portion of the capacitor changes the capacitance. Another MEMS device is an RF (radio frequency) ohmic switch. In a typical MEMS ohmic switch, application of an electrical signal causes a cantilevered metal arm to either ground or remove from ground state a signal line by completing or breaking ohmic contact with the signal line. Dielectric layers in MEMS devices are used to prevent the membrane, cantilevered arm, or other moving switch pad from making physical contact with other portions of the MEMS device.

MEMS lifetimes continue to be shorter than would make their use widespread. Successes in the range of 1–3 billion "cold" switching cycles have been reported. High frequency applications are especially suited to MEMS devices, but can exceed reported switching cycles in ordinary usage. Also, there is typically a difference between "hot" and "cold" switching lifetimes. "Hot" switching, i.e., a switching test conducted with signals present, is a different measure of operational conditions that usually shows a shorter lifetime than "cold" switching tests would indicate. This is mentioned only to identify that test results are understood with reference to the test conditions. Both types of tests are valid and generally accepted in the art, but only the same types of tests can be directly compared.

A common cause of failure is a stuck switch pad, recognized by experience to be the sticking of the movable switch pad to a dielectric layer. The exact mechanisms for this sticking are not completely understood. Sticking has been attributed to charging of dielectric layers used to isolate electrical contact between the moving switch pad of a MEMS device and an actuation component of the MEMS device. Another common cause of failure and operational inefficiency is the tendency of the switch pad to deform due to spring force. It can move further away from an actuation pad, first leading to an increased voltage required for operation of the switch and eventually leading to a failure.

SUMMARY OF THE INVENTION

A high life cycle MEMS device is provided by the invention. In an aspect of the invention, separate support posts are disposed to prevent a suspended switch pad from touching the actuation pad while permitting the switch pad to ground a signal line. In another aspect of the invention, cantilevered support beams are made from a thicker material than the switching pad. Thicker material in the cantilever tends to keep the switch pad flat in its resting position. Features of particular preferred embodiments include dimples in the switch pad to facilitate contact with a signal line and serpentine cantilevers arranged symmetrically to support the switch pad.

BRIEF DESCRIPTION OF THE DRAWINGS

FIG. 5A is a schematic side view of a preferred embodiment MEMS switch of the invention in a relaxed (ungrounded) state;

FIG. 5B is a schematic side view of the FIG. 5A switch in an actuated (grounded) state.

DETAILED DESCRIPTION OF THE PREFERRED EMBODIMENTS

Aspects of the invention are directed generally to the cycle life, manufacturing yield, and electrical efficiency of MEMS devices, e.g., shunt switches. For example, aspects of the invention produce electrical efficiency, i.e., low voltage operation, by addressing the issues of residual stress and electrical contact in the switch. The residual stress in the switch adversely affects the required actuation voltage by causing the switch to bend such that the distance between it and the signal path increases. Cantilevered support of a moving switch pad in the invention provides for a strong return-to-flat tendency. As a distance between an actuation pad and a moving switch pad is maintained, a consistent and low actuation voltage is possible. Cycle life and, to some extent, electrical efficiency are also addressed by an aspect of the invention that permits an exposed actuation pad. In prior devices with dielectric layers used to prevent contact between the actuation pad and moving (shunt) pad, an unresolved issue of attraction between the actuation pad and the moving pad leads to low cycle lifetimes as the actuation pad and moving switch pad become stuck. Support posts in preferred embodiments of the invention permit an exposed actuation pad or an actuation pad with dielectric. A dimpled switch pad feature facilitates good electrical contact to the signal path or a variable capacitor operation. Embodiments of the invention may be formed in a Group III–V material system. In addition, the invention has been demonstrated to work with a silicon based integration. Use of silicon requires a deposition of a polymer upon the silicon substrate prior to formation of the MEMS device.

Figure 1:
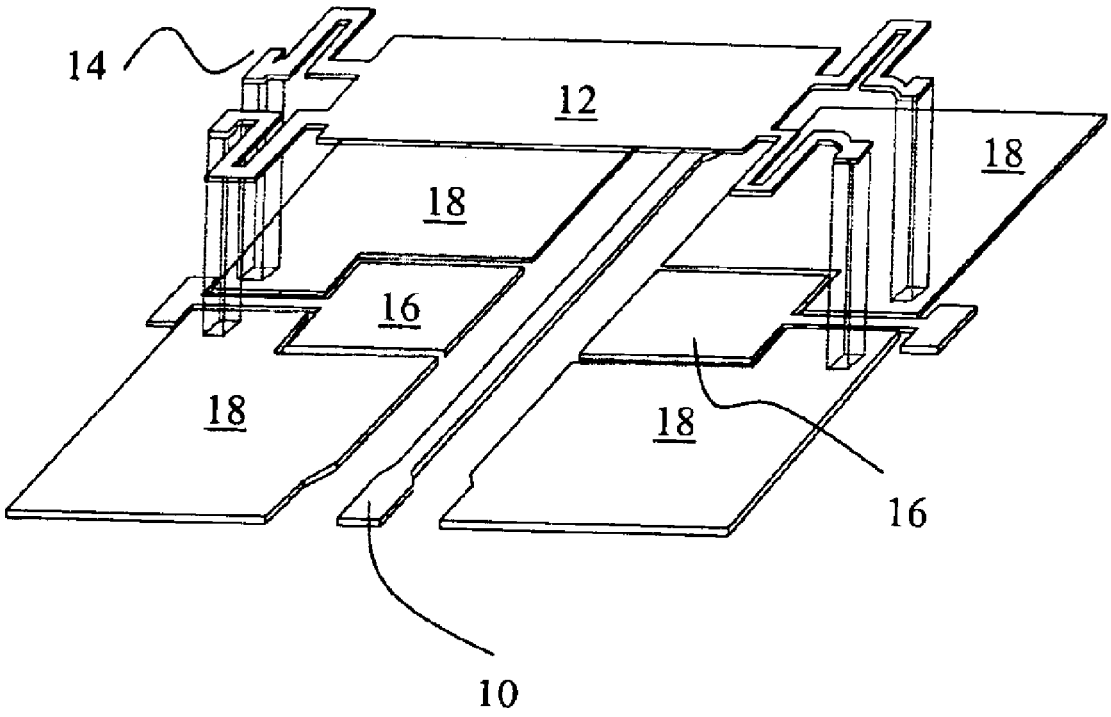
FIG. 1 is a schematic of a preferred embodiment RF MEMS shunt switch.

Aspects of the invention may be applied separately, while particularly preferred embodiments make simultaneous use of aspects of the invention. Referring now to FIG. 1, a preferred embodiment RF MEMS shunt switch is shown. The function of the RF MEMS switch of FIG. 1 is to control a signal line 10 to selectively permit the flow of signals through the signal line 10 in response to a control signal. Signal flow is permitted when a metal switch pad 12 suspended over the signal line 10 is not in contact with the signal line 10. In the preferred embodiment of FIG. 1, the relaxed state of the switch is the state when signal flow is permitted to pass through the signal line 10. In the relaxed state, cantilevers 14 hold the metal switch pad 12 above the signal line 10. Application of a control signal to an actuation pad (or pads) 16 will ground the signal line 10 by pulling the metal switch pad 12 into contact with the signal line 10 and a ground 18.

In the application of a MEMS switch, this operation will be repeated many times. One life-and efficiency-limiting problem of conventional switches is the tendency of the thin metal switch pad 12 to bow out away from the signal line 10 due to the forces applied by flexible cantilevers 14. In an aspect of the invention, cantilevers 14 are arranged to create a balanced switch. The cantilevers 14 preferably have a serpentine shape and are arranged symmetrically to be disposed proximate corners of the metal switch pad 12, which, in the preferred embodiment, has a generally rectangular shape. With other shaped metal switch pads, symmetry is preferably maintained in the arrangement of the cantilevers 14 and will depend upon the shape.

Figure 2A:
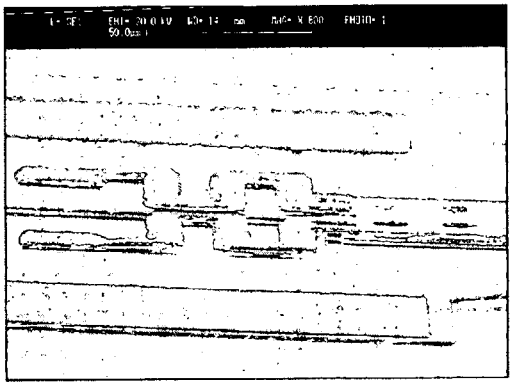
FIGS. 2A and 2B are SEM images of the cantilever portion of a prototype device of the invention.
Figure 2B:
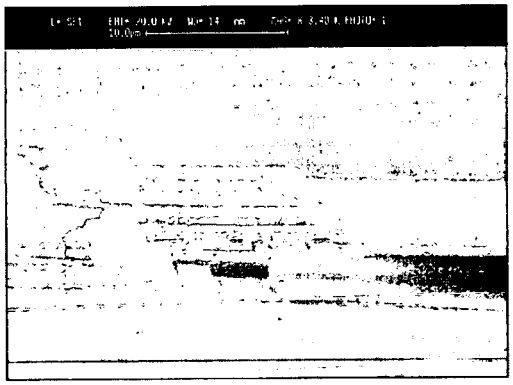

Another feature of the cantilevers 14 concerns their relative thickness in relation to the metal switch pad 12. FIGS. 2A and 2B are SEM images of a prototype MEMS device of the invention. Magnification in FIG. 2B is greater than in FIG. 2A. An additional selective deposition process is used to thicken the cantilevers after an initial deposition process forms the cantilevers 14 and the metal switch pad 12. The thickened cantilevers 14 have increased mechanical strength. Their higher spring constant provides a restoring force that keeps the switch flat. In preferred embodiments, the metal switch pad 12 has a thickness in the approximate range of 0.1 $\mu$m to 3 $\mu$m, and the cantilevers 14 have an additional thickness in the approximate range of 0.3 $\mu$m to 1.5 $\mu$m. A particularly preferred embodiment has cantilevers with an additional 0.75 $\mu$m to 1.0 $\mu$m thickness.

The importance of this feature is that the flatness of the switch can be maintained even though the switch is made very thin, and these flat, thin switches allow low voltage operation to be achieved. Tests were conducted on prototypes to compare the actuation voltage required. Without thickened cantilevers, an average actuation voltage of about 15–17 volts was measured, while thickened cantilever prototypes had an average actuation voltage of about 8 volts. The thickened cantilevers should also increase switch lifetime by inhibiting the tendency of the mechanical forces to gradually bow the metal switch pad away from the actuation pads until the gap becomes great enough to prevent the actuation voltage from operating the switch.

Figure 3:
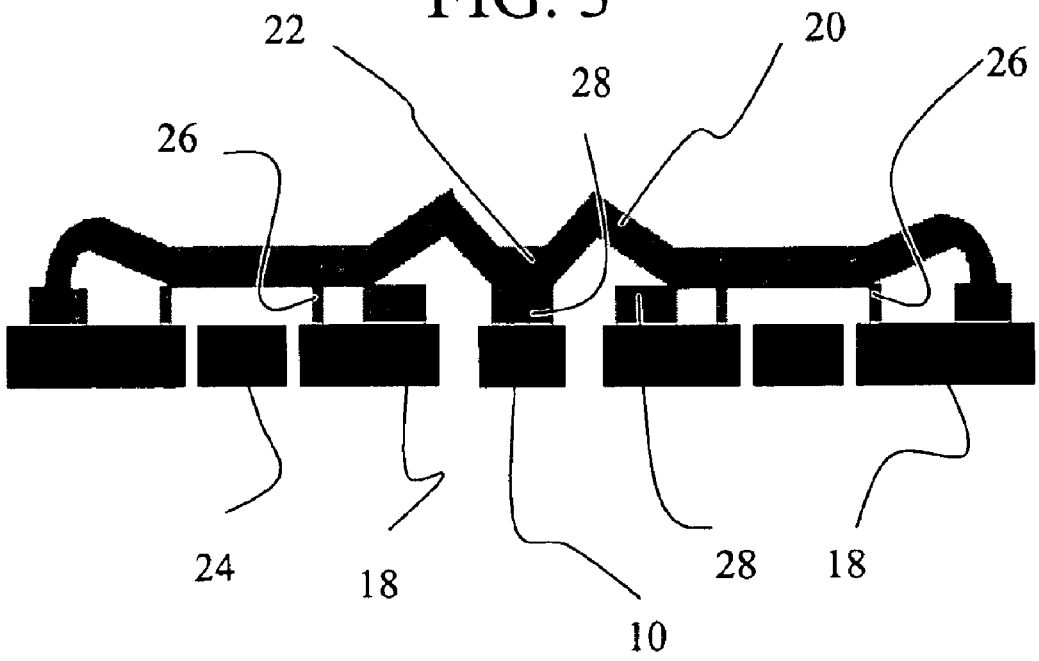
FIG. 3 is a schematic side view of a preferred embodiment MEMS device of the invention.
Figure 4:
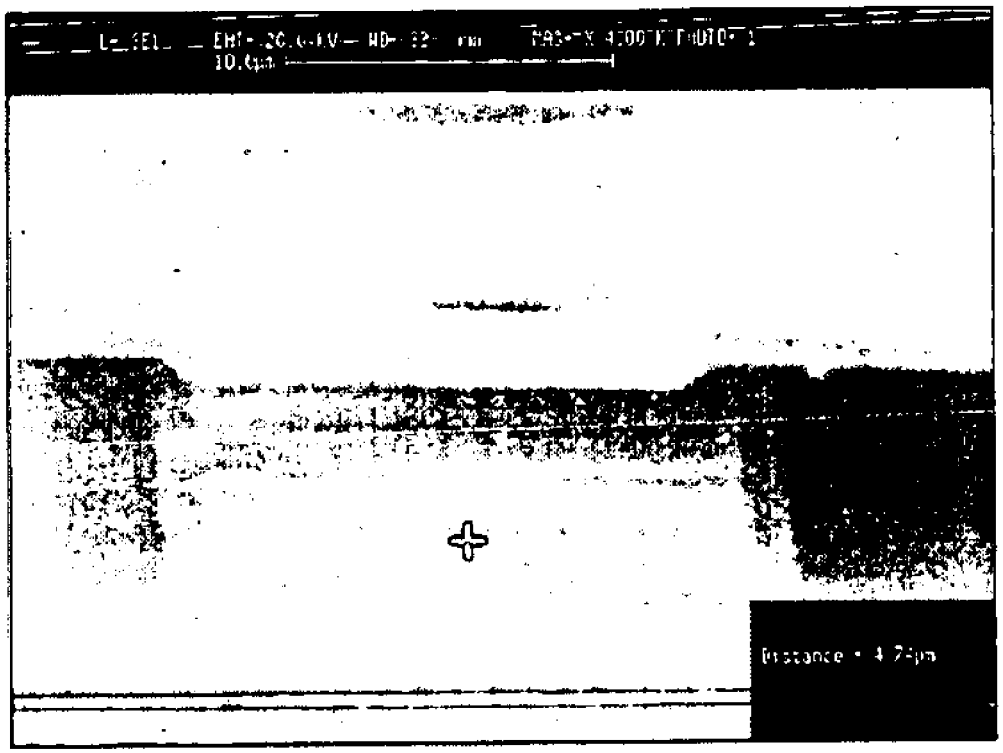
FIG. 4 is an SEM image of a center portion of a prototype device of the invention.

Another feature addressing actuation voltage and cycle lifetime is a preferred dimpling of the metal switch pad in the area where the metal switch pad makes contact. FIG. 3 is a schematic side view illustrating, in exaggerated fashion, a dimpled metal switch pad 20 and FIG. 4 is an SEM image of a metal switch pad portion of a prototype including a dimpled metal switch pad. A dimple 22, as seen in FIG. 3, is formed over the signal line 10, but may also be aligned with the grounds 18. The dimple 22 is created by partially etching the sacrificial layer upon which the metal switch pad 12 is formed. The partial etching creates a depression. The dimple 22 is formed in the depression when the metal actuation pad 20 is formed. The metal actuation pad with dimple or dimples is then released upon consumption of the sacrificial layer. The effect is that the center portion of the metal switch pad 20 is lowered at the dimple 22 such that when the metal switch pad 20 is pulled down the first thing to contact the signal line 10 is the dimple 22. The basic FIG. 3 structure also provides for a variable capacitor when the range of the pull down of the metal switch pad 20 does not include contact with the signal line 10. The dimpling is an efficient way to create variable capacitors by adjusting the dimple depth and thereby not making contact to the signal line. Changing the gap between signal and ground changes the capacitance through an actuation voltage applied in an actuation pad 24.

Figure 6:
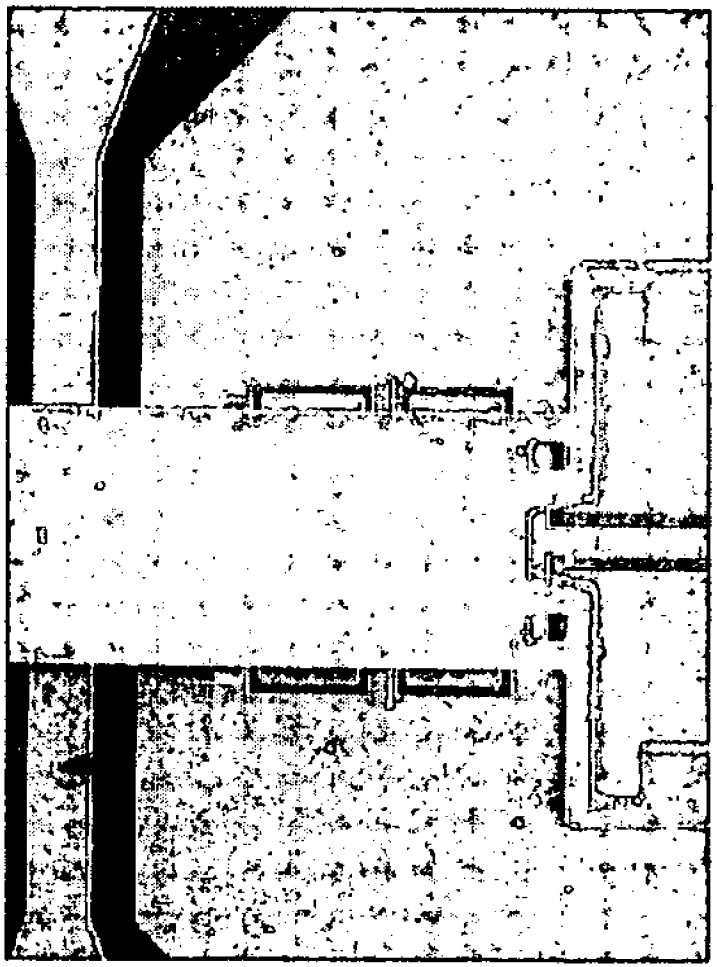
FIG. 6 is an SEM image of a support post feature of a prototype device of the invention.

FIG. 3 also illustrates support posts 26, shown in additional detail in FIGS. 5A and 5B, and raised contact bumps 28 to the signal line 10 and ground 18. The support posts 26 are disposed to prevent the metal switch pad 12 from contacting the actuation pads 16. The actuation pad 24 may include a dielectric, or may be an exposed metal. The raised contact bump 28 facilitates electrical contact and reduces the gap between it and the dimple 22. The support posts 26 in FIGS. 5A and 5B are disposed around the actuation pad 12 and are high enough to stop the metal switch pad before it contacts the actuation pads. The posts 26 are preferably disposed on multiple sides of the actuation pads 16 and are preferably fabricated close to the actuation pads 16. The support posts 26 may be formed to ground contact. In this way, the posts 26 will direct some current from the signal line 10 to ground, with the remainder being directed through the cantilevers 14. Posts are shown in the partial SEM image of a prototype in FIG. 6. In a preferred low voltage embodiments, posts have a height in the approximate range of 0.5 to 1.25 $\mu$m and an actuation pad (with dielectric) is approximately 1000 Å to 2000 Å. Some applications, e.g., wireless RF devices, permit higher actuation voltages. In such applications, higher posts are preferred to enhance lifetimes. For example, a preferred range for the posts in such devices is 0.5 $\mu$m to 100 $\mu$m with an actuation pad of approximately 1000 Å to 2000 Å.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. An MEMS shunt switch, comprising:

a signal line;

a conductive switch pad suspended over said signal line;

a conductive actuation pad below the conductive switch pad; and support posts disposed to prevent the conductive switch pad from touching the conductive actuation pad while simultaneously permitting said conductive switch pad to contact said signal line.

2. The switch of claim 1, wherein said actuation pad is exposed.

3. The switch of claim 1, wherein said actuation pad has a dielectric.

4. The switch of claim 1, wherein said conductive switch pad is grounded.

5. The switch of claim 1, wherein said support posts are disposed on at least two sides of said actuation pad.

6. The switch of claim 1, wherein said conductive switch pad includes a dimpled portion aligned over said signal line.

7. The switch of claim 6, further comprising a raised contact bump on said signal line.

8. The switch of claim 1, wherein said conductive switch pad is suspended by cantilevers and said cantilevers have a thickness greater than said conductive switch pad.

9. The switch of claim 8, wherein said conductive switch pad includes a dimpled portion aligned over said signal line.

10. The switch of claim 1, wherein said conductive switch pad is supported on two opposite sides by symmetrically arranged cantilevers.

11. The switch of claim 10, wherein said cantilevers have a serpentine shape.

12. The switch of claim 11, wherein said cantilevers have a thickness greater than said conductive switch pad.

13. The switch of claim 1, wherein said support posts have a height in the approximate range of 0.5 to 1.25 $\mu$m and said actuation pad has a height in the approximate range of 1000 Å to 2000 Å.

14. An RF MEMS shunt switch, comprising:

a signal line;

a conductive switch pad suspended over said signal line;

an exposed conductive actuation pad below the conductive switch pad; and means for preventing the conductive switch pad from touching the exposed conductive actuation pad and for permitting said conductive switch pad to ground said signal line.

15. The switch of claim 14, wherein said means for preventing comprises support posts.

16. The switch of claim 15, wherein said support posts have a height in the approximate range of 0.5 to 1.25 $\mu$m and said actuation pad has a height in the approximate range of 1000 Åto 2000 Å.

17. An RF MEMS device, comprising:

a signal line;

a conductive switch pad suspended over said signal line;

a conductive actuation pad below said conductive switch pad; and a dimpled portion in said conductive switch pad aligned with said signal line, said dimpled portion reducing distance between itself and said conductive switch pad compared to remaining portions of said conductive switch pad.

18. The RF MEMS device of claim 17, wherein a movement range of said conductive switch pad permits said dimpled portion to contact said signal line and the device is an RF MEMS shunt switch.

19. The RF MEMS device of claim 17, wherein a movement range of said conductive switch pad retains a gap between said dimpled portion and said signal line and the device is an RF MEMS variable capacitor.

* * * * *